US005905424A

United States Patent [19]

Panchanathan

[11] Patent Number: 5,905,424

[45] Date of Patent: May 18, 1999

[54] BONDED MAGNET MADE FROM GAS ATOMIZED POWDERS OF RARE EARTH ALLOY

[75] Inventor: Viswanathan Panchanathan, Anderson, Ind.

[73] Assignee: Magnequench International, Inc., Anderson, Ind.

[21] Appl. No.: 08/905,897

[22] Filed: Aug. 4, 1997

[51] Int. Cl.[6] ..... H01F 7/02

[52] U.S. Cl. ..... 335/302; 148/102; 419/61

[58] Field of Search ..... 335/300–306; 148/102, 104; 419/61, 66

[56] References Cited

U.S. PATENT DOCUMENTS 4,802,931 2/1989 Croat .
4,851,058 7/1989 Croat .
5,486,240 1/1996 McCallum et al. ..... 148/102
5,690,889 11/1997 McCallum et al. ..... 420/83

OTHER PUBLICATIONS

Sellers et al., "Amorphous Rare Earth Magnet Powders", paper presented at the conference in Brazil during Sep. 1996.

*Primary Examiner*—Lincoln Donovan

[57] ABSTRACT

Bonded magnets made from gas atomized powders of an rare earth alloy and having good hard magnetic characteristics are provided. The powders have an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu.

18 Claims, 2 Drawing Sheets

BONDED MAGNET MADE FROM GAS ATOMIZED POWDERS OF RARE EARTH ALLOY

FIELD OF THE INVENTION

The present invention relates to a bonded magnet and more particularly, a bonded magnet made from gas atomized powders of a rare earth alloy.

BACKGROUND OF THE INVENTION

Recently significant progress has been made in improving the hard magnetic properties of Nd—Fe—B powders produced by inert gas atomization. Making useful bonded magnets from gas atomized Nd—Fe—B powders, however, has been hampered by the severe degradation of the hard magnetic properties of the bonded magnets after they are made. The degradation occurs mainly after a process for curing a binder in which the powders mixed or coated with the binder and pressed into a desired shape are heated at an elevated temperature (e.g., 175° C.) for a time period sufficient to cure such binder. It is observed, however, that bonded magnets made from powders produced by a melt spinning process do not exhibit such significant degradation of its hard magnetic properties after such curing process.

The present invention provides a bonded magnet made from gas atomized rare earth alloy powders which has good hard magnetic properties after the process for curing the binder.

SUMMARY OF THE INVENTION

The present invention provides a bonded magnet made from alloy powders produced by gas atomization and exhibiting good hard magnetic characteristics. It is discovered by the inventor of the present invention that the degradation of the hard magnetic properties of a bonded magnet made of atomized powders is mainly caused by chemical and/or physical defects created below an oxide layer formed at the surface of the powders during the process for curing the binder. In accordance with the present invention, titanium carbide ("TiC") is added to the alloy prior to the gas atomization process, resulting in the gas atomized powders having a fine nanocrystalline grain structure similar to that of alloy powders made by the well known melt spinning process. Without the addition of TiC, the grain structure of gas atomized powders is very coarse. Due to this change of the grain structure, degradation of the hard magnetic properties after the process for curing the binder is substantially eliminated.

The addition of TiC to the rare earth alloy may be accomplished by adding a TiC compound into a rare earth alloy melt. Alternatively, substantial stoichiometric amounts of Ti and C are added to a rare earth alloy melt to form TiC precipitates.

In accordance with the present invention, a bonded magnet is made from alloy powders produced by gas atomization. The alloy powders have an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu. Preferably, the proportion of RE in the alloy is approximately 25 to 32 weight %.

Other metals may also be present in minor amounts of up to two weight percent, either alone or in combination. These metals include tungsten, chromium, nickel, aluminum, copper, magnesium, manganese, gallium, vanadium, molybdenum, tantalum, zirconium, tin, and calcium. Silicon is also present in small amounts, as are oxygen, hydrogen, and nitrogen. In an alternative embodiment, hydrogen may be removed during processing to yield a bonded magnet substantially free of hydrogen.

A bonded magnet is made by mixing or coating the powders with a binder and curing such binder at an elevated temperature for a time period sufficient to cure such binder. Preferably, prior to mixing or coating the powders with the binder, the powders are annealed at a temperature above 500° C. More preferably, prior to curing the binder, the powders mixed or coated with the binder are pressed or molded into a desired shape. In accordance with the present invention, a bonded magnet having a maximum energy product of at least 4 MGOe is achieved.

BRIEF DESCRIPTION OF THE DRAWINGS

Those and other objects, features and advantages of the present invention will be more apparent from the following detailed description in conjunction with the appended drawings in which.

DETAILED DESCRIPTION OF THE INVENTION

The present invention will now be described in detail with the following examples.

EXAMPLE 1

An alloy having a composition of 30.1 weight % of Nd, 0.91 weight % of B, and balanced with Fe, is gas atomized using an inert gas using a laboratory scale atomizer at 1400° C. The average size of the atomized powders is less than 50 $\mu$m in diameter. The powders are then annealed for 10 min at 650° C. The maximum energy product of the powders is 0.9 MGOe. No bonded magnet is made since the energy product is too low.

EXAMPLE 2

Figure 1:
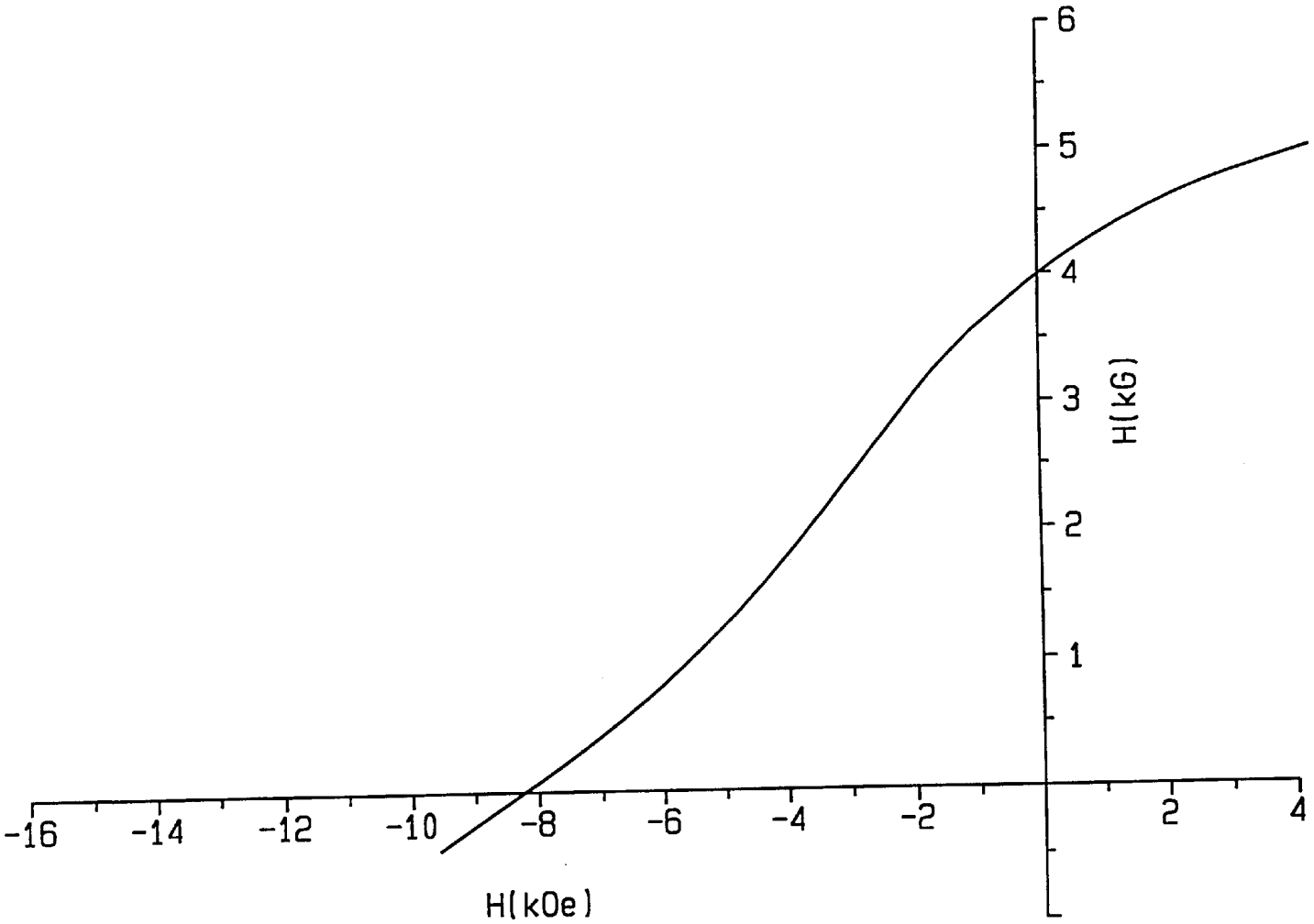
FIG. 1 shows the demagnetization curve of a bonded magnet detailed in Example 2 below.

An alloy having a composition of 31.7 weight % of Nd and Pr, 2.8 weight % of Dy, 1.1 weight % of B, and balanced with Fe, is gas atomized using an inert gas using a laboratory scale atomizer at 1400° C. The average size of the gas atomized powders is less than 50 $\mu$m in diameter. The powders are then annealed at 640° for 4 min. The properties of the powder after annealing are as follows: $B_r$ is 5.95 kG; Hci is 13.67 kOe; and BHmax 7.2 MGOe. The annealed powders are then mixed with 3 weight % epoxy as a binder, and are molded and compressed into a desired shape. It is then cured at 170° C. for 30 minutes. After curing, the Hci of the bonded magnet dropped to 8.2 kOe from 13.67 kOe. The shape of the demagnetization curve, which is shown is FIG. 1, is poor.

EXAMPLE 3

Figure 2:
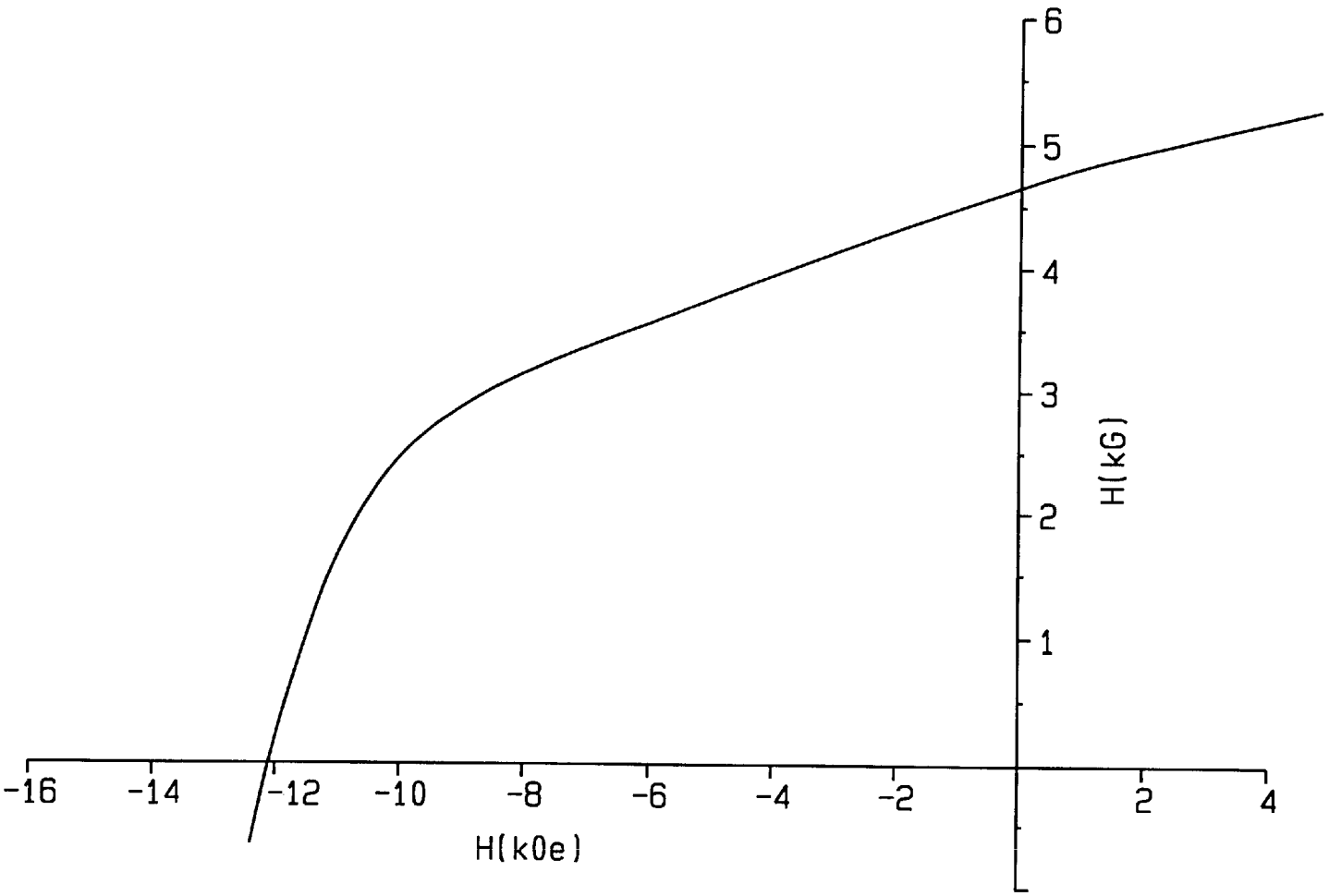
FIG. 2 shows the demagnetization curve of a bonded magnet described in Example 3 below.

An alloy of a composition similar to that of Example 1 along with 3 weight % of TiC is gas atomized using an inert gas. The average size of the gas atomized powders is less that 30 $\mu$m in diameter. The powders are then annealed at 800° C. for 30 minutes. The magnetic properties of the annealed powders are as follows: $B_r$ is 7.07 kG; Hci is 12.2 kOe; BHmax is 9.75 MGOe. The annealed powders are then mixed with 5 weight % of epoxy, molded and compressed into a desired shape. It is cured at 170° C. for 30 minutes. The demagnetization curve of the bonded magnet is shown in FIG. 2. Note the Hci value remains very close to that of the powders. This indicates that the bonded magnets made from gas atomized powders of an rare earth alloy with the addition of TiC have good hard magnetic properties without any substantial loss in coercivity.

EXAMPLE 4

The annealed powders of example 2 are encapsulated with 3 weight % of epoxy and then molded and compressed into a desired shape. After it is cured at 170° C. for 30 minutes, the coercivity value of the magnet dropped to a value similar to example 2. The encapsulation does not prevent the Hci loss during curing.

EXAMPLE 5

Bonded magnets made from the powders of Example 3 having a diameter of 0.33" and height 0.23" are made for aging study. They are aged at 80° C. and 100° C. for 1000 hours. The total losses at 80° C. and 100° C. are respectively 2.8% and 5.7%.

Thus, in accordance with the present invention, bonded magnets are successfully made from gas atomized rare earth alloy powders containing TiC as an addition. The proportion of TiC in the alloy is approximately between 0.5 and 4 weight % and preferably between 2 and 4 weight %. Less TiC proportion is not effective; more TiC proportion reduces the magnetic properties.

While the examples describe making bonded magnets made by a compression molding process, other bonding method, such as injection and extrusion, may also be used with this powders to make bonded magnets. As to the binders used in making bonded magnets, they vary depending on the bonding processes employed. They include epoxy, polyester, different types of polyamides, teflon, nylon, rubber, polyacrylate, or any other kind of available and suitable binders.

It should be apparent to one of ordinary skill in the art that although the examples describe making rare earth powders by inert gas atomization, other types of atomization processes, such as centrifugal atomization, may also be used to make atomized rare earth alloy powders and bonded magnets in accordance with the present invention.

Although the present invention has been described with reference to examples, it will be appreciated by those of ordinary skill in the art that modifications can be mode to the structure and form of the invention without departing from its spirit and scope which is defined in the following claims.

What is claimed is:

1. A bonded magnet made by (a) mixing or coating alloy powders produced by gas atomization with a binder and (b) curing such binder by heating the powder mixed or coated with the binder at a temperature below 300° C. for a period of time sufficient to cure such binder, the powders having an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu.

2. The bonded magnet of claim 1 wherein the proportion of RE in the composition is approximately between 25 and 32 weight %.

3. The bonded magnet of claim 1 wherein the proportion of TiC in the composition is approximately between 2 to 4 weight %.

4. The bonded magnet of claim 1 wherein the amount of the binder added to the powders is approximately 1.5 to 5 weight % prior to the curing process.

5. The bonded magnet of claim 1 wherein the proportion of Co in the composition is from 0 to 15 weight %.

6. The bonded magnet of claim 1 exhibiting a maximum energy product of no less than 4 MGOe.

7. A bonded magnet made by (a) mixing or coating alloy powders produced by inert gas atomization with a binder and (b) curing such binder by heating the powder mixed or coated with the binder at an elevated temperature for a period of time sufficient to cure such binder, the powders having an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu, and the bonded magnet exhibiting a maximum energy product of no less than 4 MGOe.

8. The bonded magnet of claim 7 wherein the proportion of RE in the composition is approximately between 25 and 32 weight %.

9. The bonded magnet of claim 7 wherein the proportion of TiC in the composition is approximately between 2 to 4 weight %.

10. The bonded magnet of claim 7 wherein the amount of the binder added to the powders is approximately 1.5 to 5 weight % prior to the curing process.

11. The bonded magnet of claim 7 wherein the proportion of Co in the composition is from 0 to 15 weight %.

12. A process for making a bonded magnet comprising the steps of:

making alloy powders by gas atomization, the powders having an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu;

mixing or coating the powders with a binder; and heating the powders at a temperature below 300° C. for a time period sufficient to cure the binder.

13. The process of claim 12 wherein the proportion of TiC in the powder is approximately between 2 to 4 weight %.

14. The process of claim 12 further comprising a step of annealing the powders at a temperature above 500° C. prior to mixing or coating the powders with the binder.

15. The process of claim 12 wherein the proportion of binder is approximately 1.5 to 5 weight % prior to the step of heating the powders and the binder.

16. The process of claim 12 further comprising a step of pressing or molding the powders mixed or coated with the binder into a desired shape prior to the step of heating the powders and binder.

17. A process for making a bonded magnet comprising the steps of:

making alloy powders by gas atomization, the powders having an alloy composition comprising approximately 15 to 34 weight % of RE, 0.8 to 1.2 weight % of B, 0.5 to 4 weight % of TiC, balanced with at least one of Fe and Co, wherein RE is one or more rare earth elements selected from the group consisting of Y, La, Ce, Pr, Nd, Sm, Er, Gd, Tb, Dy, Ho, Er, Tm, Yb and Lu;

annealing the powders at a temperature above 500° C.;

mixing or coating the powders with a binder;

pressing or molding the powders mixed or coated with the binder into a predetermined shape; and heating the powders and binder at a temperature below 300° C. for a predetermined period of time to cure the binder.

18. The process of claim 17 wherein the proportion of binder is approximately 1.5 to 5 weight % prior to the step of heating the powders and the binder.

* * * * *